US008398417B2

(12) United States Patent
Ozeki

(10) Patent No.: US 8,398,417 B2
(45) Date of Patent: Mar. 19, 2013

(54) ELECTRICAL CONNECTOR HAVING A SHELL MEMBER WITH A HOLDING PORTION AND A RELEASE PORTION CONNECTED BY A CONNECTING PORTION

(75) Inventor: Kosuke Ozeki, Fukuoka (JP)

(73) Assignee: Dai-Ichi Seiko Co., Ltd. (JP)

( * ) Notice: Subject to any disclaimer, the term of this patent is extended or adjusted under 35 U.S.C. 154(b) by 0 days.

(21) Appl. No.: 13/368,187

(22) Filed: Feb. 7, 2012

(65) Prior Publication Data

US 2012/0208385 A1 Aug. 16, 2012

(30) Foreign Application Priority Data

Feb. 14, 2011 (JP) ..... 2011-028177

(51) Int. Cl.
*H01R 13/15* (2006.01)

(52) U.S. Cl. ..... 439/260

(58) Field of Classification Search ..... 439/260, 439/329, 342, 152–160
See application file for complete search history.

(56) References Cited

U.S. PATENT DOCUMENTS 7,347,720 B2 * 3/2008 Takashita ..... 439/495
7,850,473 B1 * 12/2010 Ozeki ..... 439/260
8,002,567 B2 * 8/2011 Hara ..... 439/329
8,221,147 B2 * 7/2012 Ozeki ..... 439/260
2004/0248447 A1 * 12/2004 Aoki ..... 439/260
2012/0083150 A1 * 4/2012 Ozeki ..... 439/345
2012/0220171 A1 * 8/2012 Shimada et al. ..... 439/660

FOREIGN PATENT DOCUMENTS

JP 2008-052993 A 3/2008
JP 2008-192574 A 8/2008

* cited by examiner

*Primary Examiner* — Chandrika Prasad
(74) *Attorney, Agent, or Firm* — Studebaker & Brackett PC; Donald R. Studebaker

(57) ABSTRACT

An electrical connector comprising a housing provided on one of opposite end portions thereof with an opening through which a flat circuit device is inserted into the housing, a plurality of conductive contacts arranged on the housing for contacting with connecting terminals on the flat circuit device in the housing, and a shell member mounted on the housing and provided therein with a holding portion operative to hold the flat circuit device in the housing. A releasing portion extends from the shell member toward the outside thereof, and a connecting portion extends from the releasing portion in a direction perpendicular to a conductive contact arrangement and the holding portion extends from the connecting portion, so that a folded-back protrusion is constituted in a body in the shell member with the releasing, connecting and holding portions.

6 Claims, 13 Drawing Sheets

ELECTRICAL CONNECTOR HAVING A SHELL MEMBER WITH A HOLDING PORTION AND A RELEASE PORTION CONNECTED BY A CONNECTING PORTION

BACKGROUND OF THE INVENTION

1. Field of the Invention

The present invention relates generally to an electrical connector, and more particularly to an improvement in an electrical connector which has a housing provided to be mounted on an electrical device such as a main solid circuit board, holding means for engaging with a flat circuit device, such as a flexible printed circuit board (hereinafter, referred to as an FPC) or a flexible flat cable assembly (hereinafter, referred to as an FFC) inserted in the housing, so as to hold the same to be prevented from getting out of the housing unwillingly, and a plurality of conductive contacts provided for coming into contact with connecting terminals provided on the flat circuit device to put the same in electrical connection with the electrical device such as the main solid circuit board.

2. Description of Related Art Including Information Disclosed Under 37 CFR 1.97 and 37 CFR 1.98

A flat circuit device, such as a relatively small-sized FPC or FFC, used in various kinds of electronic apparatus is often mounted on a main solid circuit board, on which various electrical parts are directly mounted, with an electrical connector which is fixed to and connected electrically with the main solid circuit board. The electrical connector has a plurality of conductive contacts, an end portion of each of which is connected electrically with a conductive circuit pattern portion formed on the main solid circuit board and which are provided for coming into contact with connecting terminals provided on the flat circuit device. The electrical connector thus provided with the conductive contacts is operative to connect electrically, through the conductive contacts, each of the connecting terminals provided on the flat circuit device with the conductive circuit pattern portion formed on the main solid circuit board.

A first type of previously proposed electrical connector used for connecting electrically a flat circuit device, such as an FPC, with a main solid circuit board, has a housing made of insulator, which is mounted on the main solid circuit board and has an opening through which at least a part of the flat circuit device is inserted into the housing. On the housing, a plurality of conductive contacts are provided to be arranged along the opening provided also on the housing. These conductive contacts are operative to come into contact respectively with a plurality of connecting terminals provided on the flat circuit device when the flat circuit device is inserted in the housing through the opening provided thereon. The previously proposed electrical connector of the first type is also provided with a shell member which covers wholly or partially the housing and is grounded to be operative to contribute to adjustment on characteristic impedance of each of the conductive contacts and to shield the conductive contacts in the housing from electromagnetic wave noises coming from the outside. The previously proposed electrical connector of the first type is further provided with an actuator which is set to be rotatable in regard to the housing so as to engage with each of the conductive contacts arranged in the housing. When the actuator is rotated in a first direction in regard to the housing, an operating portion of each of the conductive contacts is moved by the actuator to put the conductive contact in press-contact with a corresponding one of the connecting terminals provided on the flat circuit device, and then, when the actuator is rotated in a second direction opposite to the first direction in regard to the housing, the conductive contacts put in press-contact with the connecting terminals provided on the flat circuit device are released from the press-contact with the connecting terminals. With the conductive contacts put in press-contact with the connecting terminals which are provided on the flat circuit device inserted in the housing, the flat circuit device is put in electrical connection with the main solid circuit board.

A second type of previously proposed electrical connector used for connecting electrically the flat circuit device with the main solid circuit board is provided with a housing to be mounted on the main solid circuit board, a plurality of conductive contacts and a shell member in such a manner as mentioned above, but is not provided with an actuator rotatable in regard to the housing. In the previously proposed electrical connector of the second type thus constituted, when the flat circuit device is inserted into the housing through an opening provided thereon, each of the conductive contacts provided in the housing to be arranged along the opening is automatically put in press-contact with a corresponding one of connecting terminals provided on the flat circuit device. That is, the flat circuit device is put in electrical connection with the main solid circuit board by means of only inserting correctly the flat circuit device into the housing through the opening provided thereon.

In the previously proposed electrical connector with or without the actuator rotatable in regard to the housing, when the flat circuit device is inserted into the housing through the opening provided thereon and the conductive contacts arranged on the housing are put in press-contact with the connecting terminals provided on the flat circuit device so that the flat circuit device is put in electrical connection with the main solid circuit board, it is required that the flat circuit device inserted in the housing is prevented from getting out of the housing unwillingly. As a matter of course, it is necessary for the flat circuit device inserted in the housing to be held stably so as not to get out of the housing unwillingly in order to keep the conductive contacts arranged on the housing properly in a condition of press-contact with the connecting terminals provided on the flat circuit device.

There has been also proposed previously an electrical connector belonging to the above mentioned first type having the housing, the conductive contacts, the shell member and the actuator, which is provided also with holding means for engaging with a flat circuit device, such as an FPC or an FFC, inserted in the housing so as to hold the same to be prevented from getting out of the housing unwillingly, as shown in, for example, the Japanese patent application published before examination under publication number 2008-52993 (hereinafter, referred to as published patent document 1).

Besides, there has been further proposed previously an electrical connector belonging to the above mentioned second type having the housing, the conductive contact and the shell member except the actuator rotatable in regard to the housing, which is provided also with holding means for engaging with a flat circuit device, such as an FPC or an FFC, inserted in the housing so as to hold the same to be prevented from getting out of the housing unwillingly, as shown in, for example, the Japanese patent application published before examination under publication number 2008-192574 (hereinafter, referred to as published patent document 2).

In the electrical connector shown in the published patent document 1, the holding means (a locking portion 11*c*) is formed in a part of the shell member (a shield plate 11) to be able to seesaw with an engaging end portion (a claw portion 11*d*) curved to the inside of the shell member. The holding means is operative to shift its position in response to a movement of the actuator (an actuator 9) provided to be rotatable in regard to the housing (a housing 3).

Then, when the actuator is rotated in a first direction in regard to the housing after the flat circuit device (an FPC 21) is inserted into a receptacle space (an FPC receptacle space 34) provided in the housing, each of the conductive contacts (first contacts 5 and second contacts 6) provided in the housing is caused by a cam (a cam portion 92 or 93) formed on the actuator to shift its position so as to be put in press-contact with a corresponding one of connecting terminals provided on the flat circuit device inserted in the housing and the holding means is caused by a cam (a cam portion 94) formed on the actuator to shift its position so as to cause the engaging end portion of the holding means to engage with an engaging portion (a recess 21*a*) formed on the flat circuit device. As a result, the flat circuit device inserted in the housing is prevented from getting out of the housing unwillingly.

After that, when the actuator is rotated in a second direction opposite to the first direction in regard to the housing under a condition wherein the engaging end portion of the holding means is put in engagement with the engaging portion formed on the flat circuit device, the cam (the cam portion 94) formed on the actuator allows the holding means to release the engaging end portion of the holding means from the engagement with the engaging portion formed on the flat circuit device. As a result, the flat circuit device is put in a condition to be able to get out of the housing.

Further, in the electrical connector shown in the published patent document 2, the shell member (a shell 4) is provided to be rotatable in regard to the housing (a housing body 2) and the holding means (a leg portion 46) in the form of a leaf spring is formed in a part of the shell member. The holding means has an engaging projection (44) formed at an end of the holding means to be curved to the inside of the shell member.

When the flat circuit device (an FPC) is inserted into the housing through the opening (an opening 21) provided thereon under a condition wherein the shell member is positioned to keep lying down on the housing so as to be close in its entirety to the housing, each of the conductive contacts (upper contacts 31 and lower contacts 32) provided in the housing is caused to be put in press-contact with a corresponding one of connecting terminals provided on the flat circuit device inserted in the housing and the engaging projection formed on the holding means is caused to engage with an engaging portion (an FPC engaging hole 2) provided on the flat circuit device. As a result, the flat circuit device inserted in the housing is prevented from getting out of the housing unwillingly.

After that, when the shell member is rotated to be positioned to keep rising from the housing under a condition wherein the engaging projection formed on the holding means is put in engagement with the engaging portion formed on the flat circuit device, the holding means formed in the shell member shifts its position in response to a movement of the shell member so as to release the engaging projection provided on the holding means from the engagement with the engaging portion formed on the flat circuit device. As a result, the flat circuit device is put in a condition to be able to get out of the housing.

In each of the electrical connectors thus proposed previously, which has the holding means operative to prevent the flat circuit device inserted in the housing from getting out of the housing unwillingly, the holding means is provided to be operative to shift its position in response to rotational movements of the actuator provided to be rotatable in regard to the housing, or the shell member for covering wholly or partially the housing is provided to be rotatable in regard to the housing and the holding means is formed in a part of the shell member to be operative to prevent the flat circuit device inserted in the housing from getting out of the housing unwillingly.

In the case of the previously proposed electrical connector which has the holding means operative to shift its position in response to the rotational movements of the actuator provided to be rotatable in regard to the housing, it is required that the holding means and the actuator are provided as separate parts independent from each other and this results in problems or disadvantages that miniaturization in the electrical connector is undesirably hindered, the number of constitutive parts of the electrical connector increases undesirably and a production cost of the electrical connector rises disagreeably. Besides, it is necessary, for causing the holding means to engage with or disengage from the flat circuit device inserted in the housing, to rotate the actuator in regard to the housing and this results in undesirable increase in an open space around the electrical connector.

In the case of the previously proposed electrical connector which has the shell member provided to be rotatable in regard to the housing and the holding means formed in the part of the shell member, since the shell member is operative to rotate in regard to the housing, any portion of the shell member is not able to be used for fastening the electrical connector to the main solid circuit board so that a separate holding-down member for fastening the electrical connector to the main solid circuit board is required and this results in problems or disadvantages that miniaturization in the electrical connector is undesirably hindered, the number of constitutive parts of the electrical connector increases undesirably and a production cost of the electrical connector rises disagreeably.

BRIEF SUMMARY OF THE INVENTION

Accordingly, it is an object of the present invention to provide an electrical connector used for connecting electrically a flat circuit device, such as an FPC or an FFC, with a solid circuit board, which comprises a housing mounted on the solid circuit board and provided thereon with an opening through which the flat circuit device is inserted into the housing, a plurality of conductive contacts provided to be arranged on the housing and a shell member covering partially the housing, and which avoids the aforementioned disadvantages encountered with the prior art.

Another object of the present invention is to provide an electrical connector used for connecting electrically a flat circuit device, such as an FPC or an FFC, with a solid circuit board, which comprises a housing mounted on the solid circuit board and provided thereon with an opening through which the flat circuit device is inserted into the housing, a plurality of conductive contacts provided to be arranged on the housing and a shell member covering partially the housing, and in which the flat circuit device inserted in the housing can be put in holding by a holding member formed in the shell member to be surely prevented from getting out of the housing unwillingly and then released from the holding by the holding member to be able to get out of the housing with a structure in which the electrical connector can be miniaturized on the whole and the number of structural parts can be reduced.

A further object of the present invention is to provide an electrical connector used for connecting electrically a flat circuit device, such as an FPC or an FFC, with a solid circuit board, which comprises a housing mounted on the solid circuit board and provided thereon with an opening through which a flat circuit device is inserted into the housing, a plurality of conductive contacts provided to be arranged on the housing and a shell member covering partially the housing, and in which the flat circuit device inserted in the housing can be surely released from holding by a holding portion formed in the shell member by means of a quite simple and easy manipulation inflicted on the shell member.

According to the present invention, as claimed in any one of claims, there is provided an electrical connector, which comprises a housing made of insulator and provided thereon with an opening through which a flat circuit device, such as an FPC or an FFC, is inserted into the housing and which opens on one of a pair of opposite end portions of the housing, a plurality of conductive contacts arranged on the housing, each of which has a connecting terminal portion projecting from the other of the pair of opposite end portions of the housing to the outside of the housing and a press-contacting portion positioned in the housing to be operative to come into press-contact with a connecting terminal provided on the flat circuit device inserted in the housing through the opening provided thereon, and a shell member mounted on the housing for covering partially the same and provided in a body therein with a holding portion operative to be put in engagement with the flat circuit device inserted in the housing for holding the same, a releasing portion operative to release the holding portion from the engagement with the flat circuit device inserted in the housing and a connecting portion for connecting the holding portion with the releasing portion, wherein the releasing portion extends to the outside of the housing from a portion of the shell member covering an end portion of one of a pair of opposite plate-shaped portions of the housing which face each other with the opening provided on the housing between, the connecting portion extends to be bent from the releasing portion toward the other of the pair of opposite plate-shaped portions of the housing in a direction perpendicular to a direction along which the conductive contacts are arranged, and the holding portion is constituted with a cantilever arm extending to be bent from the connecting portion into the housing and an engaging projection formed at an end of the cantilever arm, so that a folded-back protrusion formed in a body in the shell member is constituted with the releasing portion, the connecting portion and the holding portion.

In the electrical connector thus constituted in accordance with the present invention, when the flat circuit device on which the connecting terminals are provided is inserted into the housing thorough the opening provided thereon, the press-contacting portion of each of the conductive contacts arranged on the housing comes into press-contact with a corresponding one of the connecting terminals provided on the flat circuit device inserted in the housing and the holding portion formed in a body in the shell member is put in engagement with the flat circuit device inserted in the housing to hold the same. As a result, the flat circuit device inserted in the housing is held by the holding member so as to be prevented from getting out of the housing unwillingly and the conductive contacts arranged on the housing are stably kept in contact with the connecting terminals provided on the flat circuit device inserted in the housing.

Then, when the releasing portion also formed in a body in the shell member is manipulated, for example, with pressure directed toward the holding portion, which is connected through the connecting portion with the releasing portion, for releasing the holding portion from the engagement with the flat circuit device inserted in the housing, the releasing portion operates to move the holding portion so as to cause the holding portion to disengage from the flat circuit device inserted in the housing. As a result, the flat circuit device inserted in the housing is released from holding by the holding member so as to be able to get out of the housing.

Functions or roles of the respective portions of the electrical connector constituted as mentioned above in accordance with the present invention are further explained in the concrete as follows, for example.

In the electrical connector according to the present invention, each of the holding portion and the releasing portion of the shell member is formed, for example, to constitute a resilient movable portion. The cantilever arm of the holding portion is, for example, operative to swing with a fulcrum placed at a root of the cantilever arm connected with the connecting portion and the engaging projection formed at the end of the cantilever arm is, for example, operative to engage with an engaging portion provided on the flat circuit device inserted in the housing. The releasing portion is, for example, operative to swing with a fulcrum placed at a root of the releasing portion connected with the shell member when the releasing portion is manipulated with the pressure directed toward the holding portion. Accordingly, for example, when the releasing portion is manipulated with the pressure directed toward the holding portion, the folded-back protrusion which is constituted in the shell member with the releasing portion, the connecting portion and the holding portion is subjected easily to resilient deformation on the whole wherein the releasing portion swings with the fulcrum placed at the root of the releasing portion connected with the shell member and the cantilever arm of the holding portion swings also with the fulcrum placed at the root of the cantilever arm connected with the connecting portion so that the engaging projection formed at the end of the cantilever arm of the holding portion disengages from the engaging portion provided on the flat circuit device inserted in the housing. Then, when the releasing portion is released from manipulation with the pressure directed toward the holding portion, the folded-back protrusion which is constituted in the shell member with the releasing portion, the connecting portion and the holding portion is restored to its condition prior to the resilient deformation by means of its own restoring resilient force.

On that occasion, the holding portion is, for example, operative to cause the cantilever arm to come into contact with a positioning portion provided on the housing so as to be restricted in its position thereby when the releasing portion is not manipulated with the pressure directed toward the holding portion and operative to cause the cantilever arm to come into contact with a contacting portion provided on the housing and besides to move the engaging projection formed at the end of the cantilever arm to approach to the root of the releasing portion connected with the shell member when the releasing portion is manipulated with the pressure directed toward the holding portion. The holding portion is, for example, further operative to cause the engaging projection formed at the end of the cantilever arm to be positioned at an inside of the opening through which the flat circuit device is inserted into the housing when the cantilever aim of the holding portion comes into contact with the positioning portion provided on the housing so that the holding portion is restricted in its position and then to cause the engaging projection formed at the end of the cantilever arm to go away from the inside of the opening through which the flat circuit device is inserted into the housing when the cantilever arm of the holding portion comes into contact with the contacting portion provided on the housing so as to move the engaging projection formed at the end of the cantilever arm to approach to the root of the releasing portion connected with the shell member.

Accordingly, the holding portion is operative to cause the engaging projection formed at the end of the cantilever arm thereof to engage with the engaging portion provided on the flat circuit device inserted in the housing under a condition wherein the releasing portion is not manipulated with the pressure directed toward the holding portion and therefore the cantilever arm of the holding portion is in contact with the positioning portion provided on the housing so that the holding portion is restricted in its position, and to cause the engaging projection formed at the end of the cantilever arm thereof to disengage from the engaging portion provided on the flat circuit device inserted in the housing under a condition wherein the releasing portion is manipulated with the pressure directed toward the holding portion and therefore the cantilever arm of the holding portion comes into contact with the contacting portion provided on the housing so as to move the engaging projection formed at the end of the cantilever arm to approach to the root of the releasing portion connected with the shell member.

Further, in the electrical connector according to the present invention, a position on the outside of the housing, at which the releasing portion of the shell member is put when the holding portion of the shell member is put in engagement with the flat circuit device inserted in the housing to hold the same, is different from a position on the outside of the housing, at which the releasing portion of the shell member is put when the holding portion of the shell member is released from the engagement with the flat circuit device inserted in the housing so as not to hold the same.

In addition, in an example of the electrical connector according to the present invention, a couple of sets of the holding portion, the releasing portion and the connecting portion of the shell member are formed in a body respectively in a pair of portions of the shell member which cover a pair of opposite end portions of one of the opposite plate-shaped portions of the housing, respectively.

With the electrical connector constituted in accordance with the present invention, as described above, when the flat circuit device, such as the FPC, the FTC and so on, is inserted into the housing thorough the opening provided thereon, the press-contacting portion of each of the conductive contacts arranged on the housing comes into press-contact with the corresponding one of the connecting terminals provided on the flat circuit device inserted in the housing and the holding portion formed in a body in the shell member is put in engagement with the flat circuit device inserted in the housing for holding the same. As a result, the flat circuit device inserted in the housing is held by the holding portion of the shell member so as to be prevented from getting out of the housing unwillingly and the conductive contacts arranged on the housing are stably kept in electrical connection with the connecting terminals provided on the flat circuit device inserted in the housing.

Then, when the releasing portion formed in a body in the shell member in addition to the holding portion is manipulated for releasing the holding portion from the engagement with the flat circuit device inserted in the housing under a condition wherein the flat circuit device inserted in the housing is put in holding by the holding portion, the releasing portion is moved to shift the holding portion through the connecting portion so that the holding portion is released from the engagement with the flat circuit device. As a result, the flat circuit device inserted in the housing is released from the holding by the holding member so as to be able to get out of the housing.

Accordingly, with the electrical connector according to the present invention, the flat circuit device inserted in the housing can be put in the holding by the holding portion formed in a body in the shell member to be surely prevented from getting out of the housing unwillingly and then released from the holding by the holding portion to be able to get out of the housing with an improved structure in which the holding portion, the releasing portion and the connecting portion are formed in a body in the shell member and with which the electrical connector can be miniaturized on the whole and the number of structural parts can be reduced.

In the electrical connector according to the present invention, since the folded-back portion formed in a body in the shell member is constituted with the releasing portion, the connecting portion and the holding portion, the holding portion can be shifted in its position on a relatively large scale through the connecting portion with a relatively small-scale movement of the releasing portion caused by the manipulation inflicted on the releasing portion. As a result, the flat circuit device inserted in the housing can be released from the holding by the holding portion with an improved structure in which the releasing portion, the connecting portion and the holding portion can be miniaturized on the whole.

Further, in the electrical connector thus constituted in accordance with the present invention, since the releasing portion of the shell member is manipulated, for example, with the pressure directed toward the holding portion of the shell member, which is put in engagement with the flat circuit device inserted in the housing to hold the same, for releasing the holding portion from the engagement with the flat circuit device, the flat circuit device inserted in the housing can be surely released from the holding by the holding portion by means of a quite simple and easy manipulation inflicted on the releasing portion of the shell member.

The above, and other objects, features and advantages of the present invention will become apparent from the following detailed description taken in conjunction with the accompanying drawings.

DETAILED DESCRIPTION OF THE INVENTION

Figure 1:
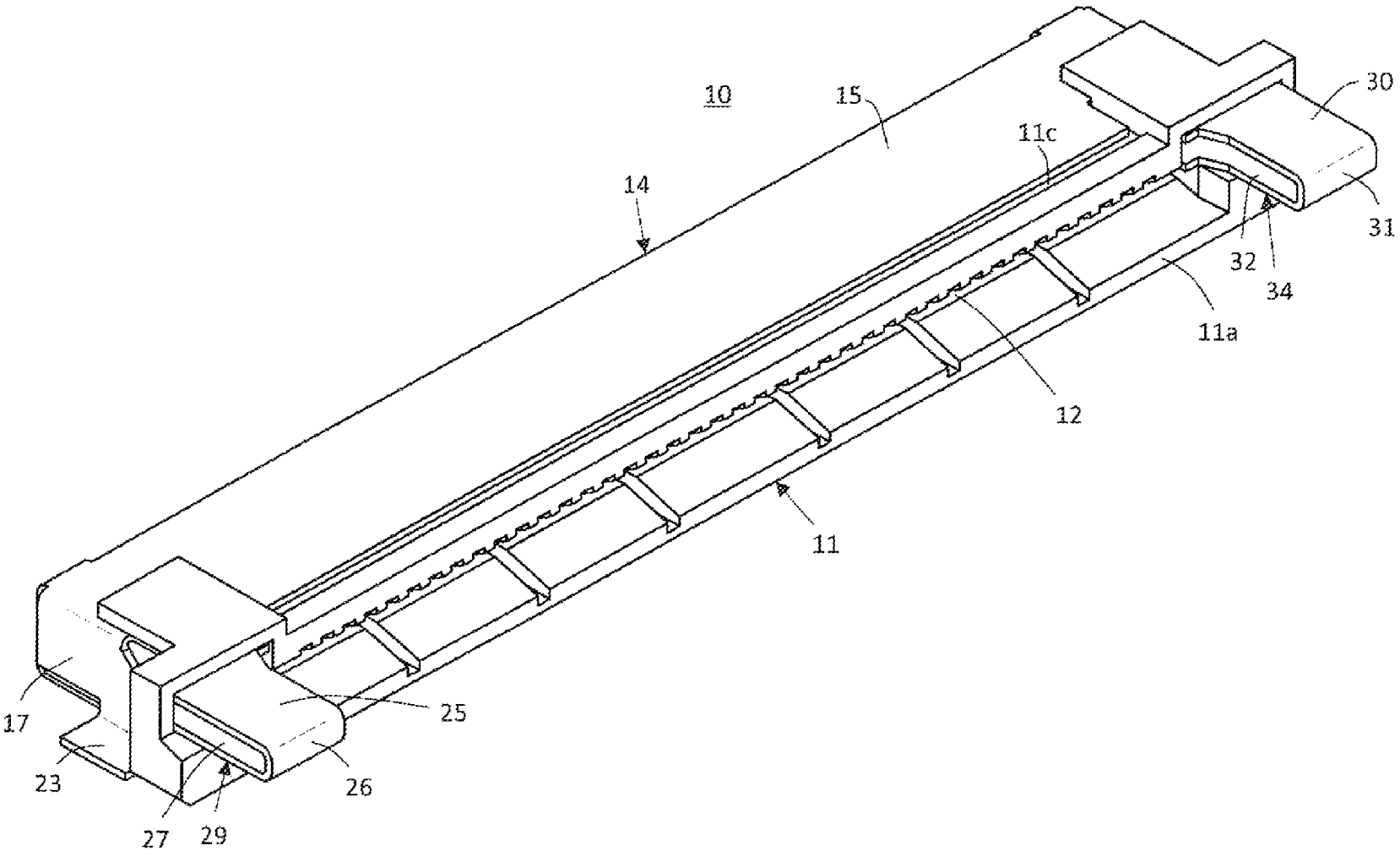
FIG. 1 is a schematic front, top and left side perspective view showing a first embodiment of electrical connector according to the present invention.
Figure 2:
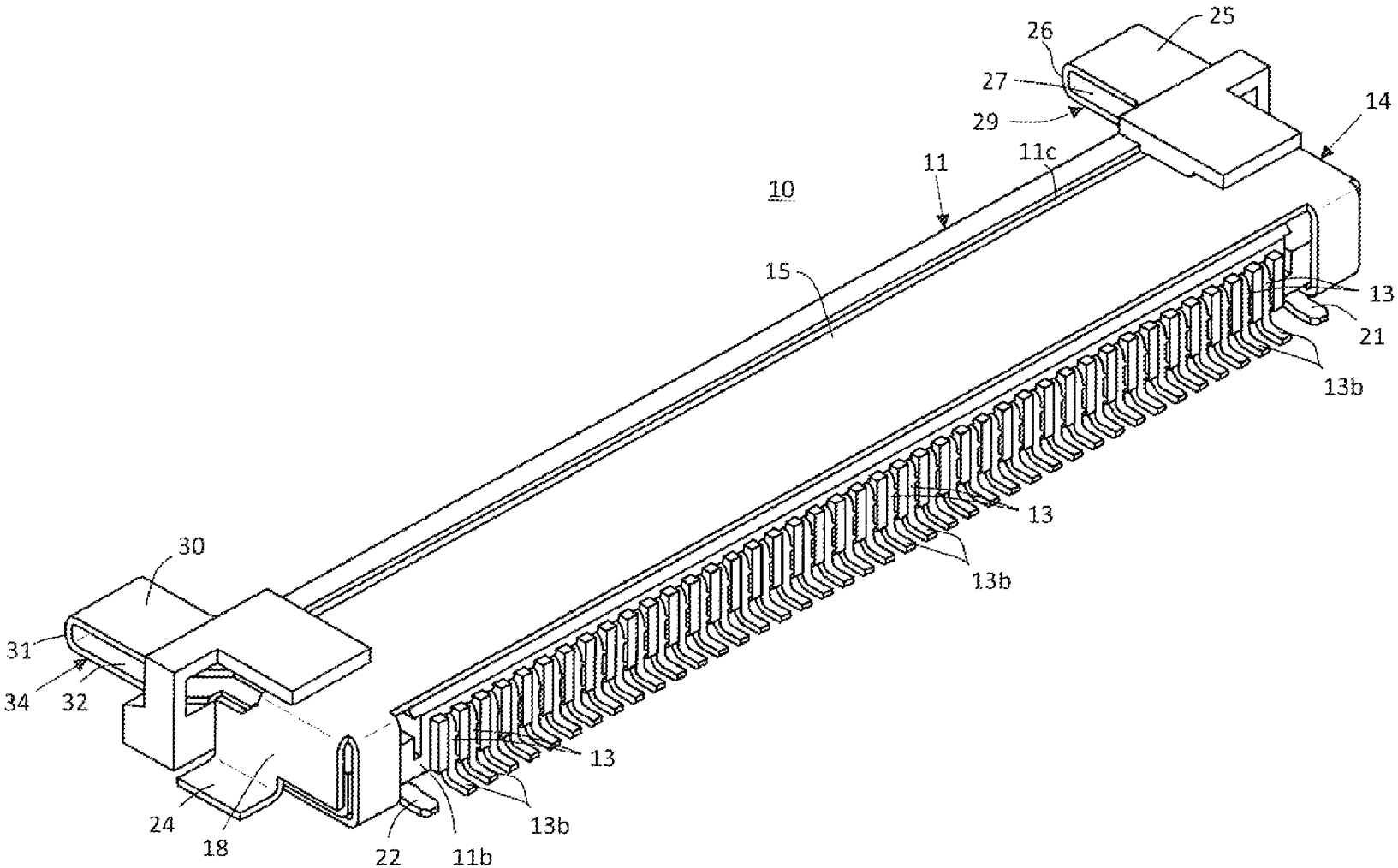
FIG. 2 is a schematic rear, top and right side perspective view showing the first embodiment shown in FIG. 1.
Figure 3:
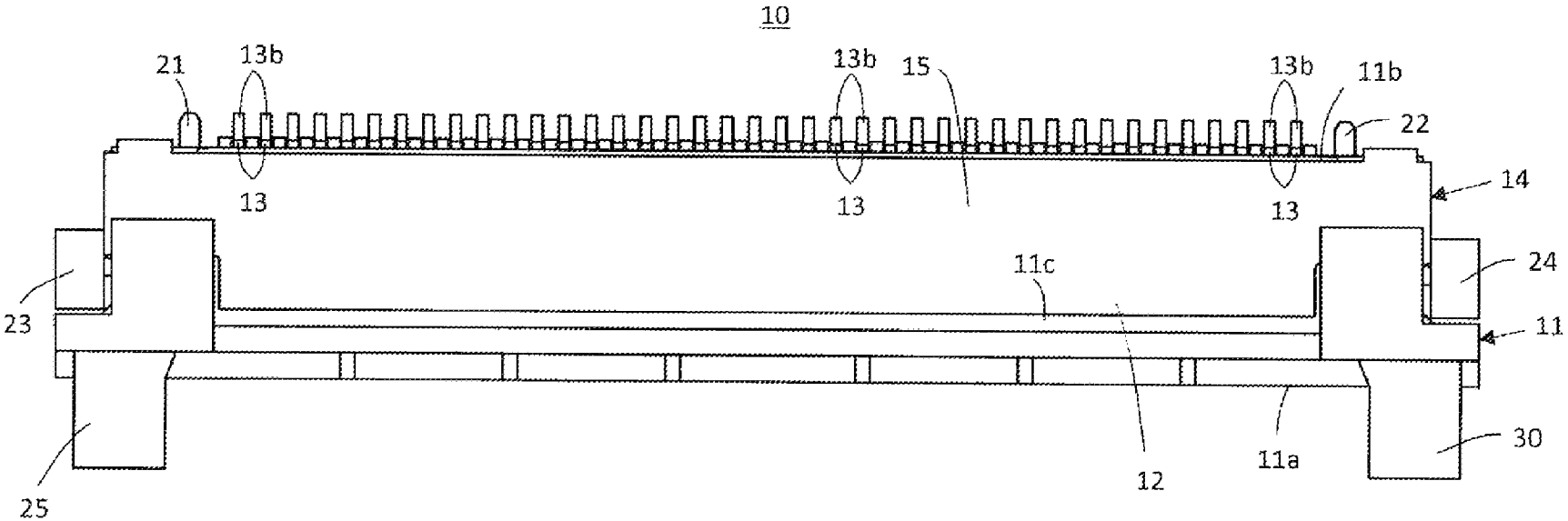
FIG. 3 is a schematic plan view showing the first embodiment shown in each of FIGS. 1 and 2.
Figure 4:
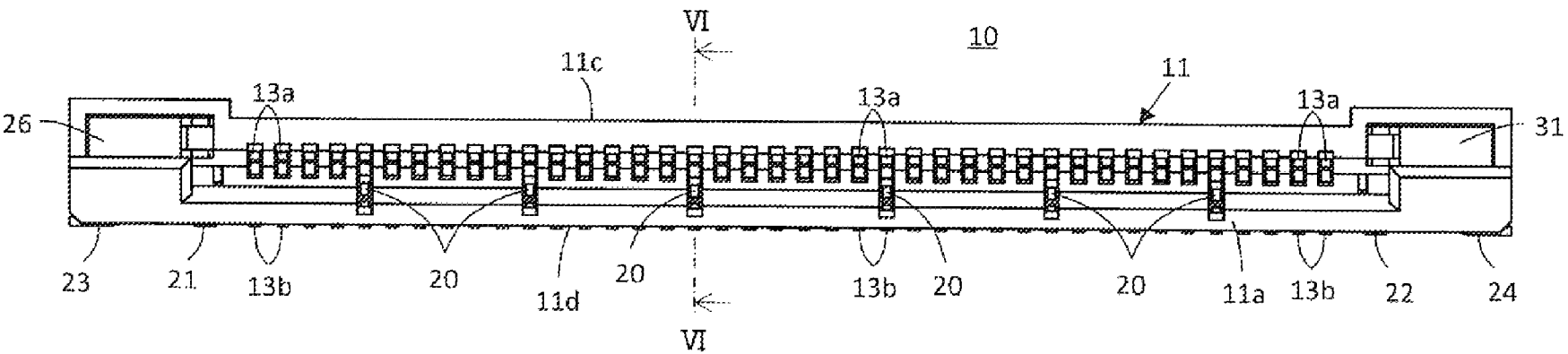
FIG. 4 is a schematic front view showing the first embodiment shown in each of FIGS. 1 and 2.
Figure 5:
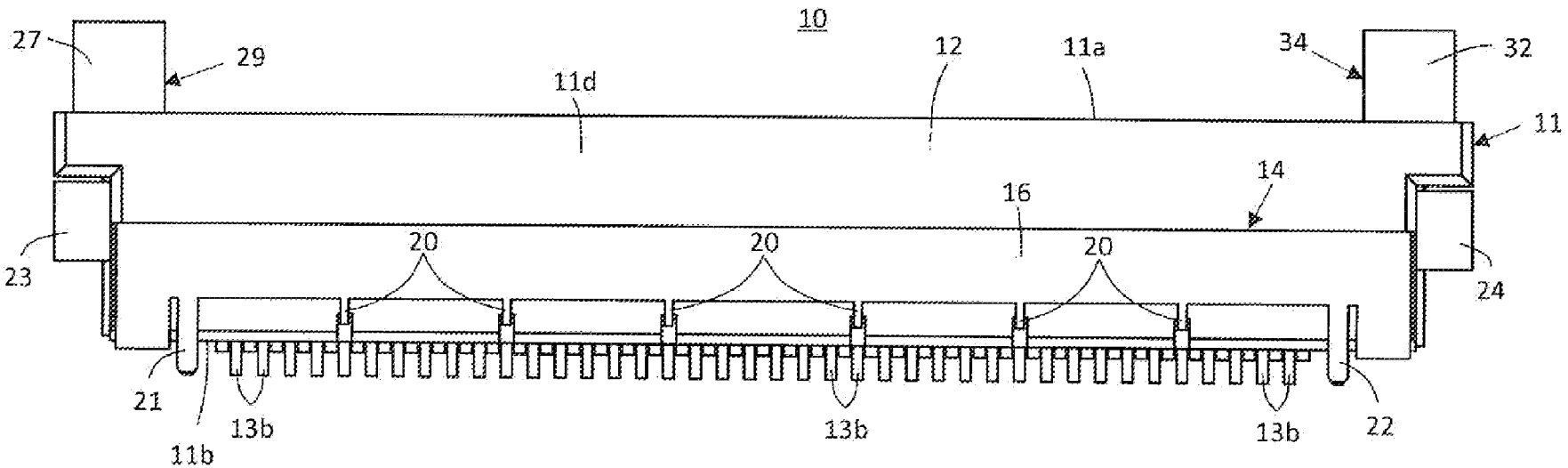
FIG. 5 is a schematic bottom view showing the first embodiment shown in each of FIGS. 1 and 2.

Each of FIG. 1 which is a schematic front, top and left side perspective view, FIG. 2 which is a schematic rear, top and right side perspective view, FIG. 3 which is a schematic plan view, FIG. 4 which is a schematic front view and FIG. 5 which is a schematic bottom view, shows a first embodiment of electrical connector according to the present invention.

In FIGS. 1 to 5, an electrical connector 10 which constitutes the first embodiment of electrical connector according to the present invention is shown. FIG. 4 is a front view showing the electrical connector 10. Hereinafter, upper, lower, left and right directions are defined on the basis of the front view of the electrical connector 10 shown in FIG. 4.

Referring to FIGS. 1 to 5, the electrical connector 10 has a housing 11 made of, for example, insulator such as plastics or the like. The housing 11 has a front end portion 11*a* and a rear end portion 11*b* which constitute a pair of opposite end portions of the housing 11, and an upper plate-shaped portion 11*c* and a lower plate-shaped portion 11*d* which constitute a pair of opposite plate-shaped portion of the housing 11. Further, the housing 11 is provided thereon with an opening 12 which opens on the front end portion 11*a* of the housing 11 and extends from the front end portion 11*a* of the housing 11 through an inside of the housing 11 toward the rear end portion 11*b* of the housing 11. Therefore, the upper plate-shaped portion 11*c* of the housing 11 and the lower plate-shaped portion 11*d* of the housing 11 face each other with the opening 12 between in the upper and lower directions.

When the electrical connector 10 is put in practical use, the housing 11 is mounted on a solid circuit board in an electronic apparatus (not shown in the drawings) with the lower plate-shaped portion 11*d* thereof facing the solid circuit board so that the electrical connector 10 is fixed in its entirety to the solid circuit board. For example, an FPC constituting a flat circuit device as explained later is inserted through the opening 12 into the housing 11 which is mounted on the solid circuit board.

Figure 6:
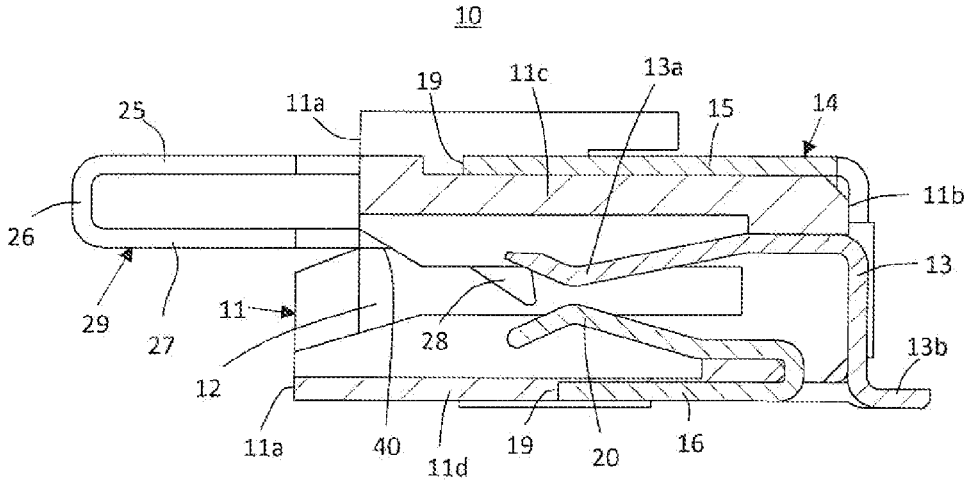
FIG. 6 is a schematic cross sectional view taken along line VI-VI on FIG. 4.

A plurality of conductive contacts 13, each of which is made of resilient conductive material, are provided on the housing 11 of the electrical connector 10 to be arranged in a longitudinal direction of the housing 11. Each of the conductive contacts 13 has a press-contacting portion 13*a* positioned in the housing 11 and a connecting terminal portion 13*b* projecting from the rear end portion 11*b* of the housing 11 to the outside of the housing 11, as shown in FIG. 4 and FIG. 6 which is the schematic cross sectional view taken along line VI-VI on FIG. 4. The press-contacting portion 13*a* of the conductive contact 13 is operative to come into press-contact with a corresponding one of connecting terminals provided on the FPC inserted in the housing 11 from the side of the upper plate-shaped portion 11*c* of the housing 11 so as to be electrically connected with the same, and the connecting terminal portion 13*b* of the conductive contact 13 is operative to be electrically connected with a signal terminal provided on the solid circuit board on which the housing 11 is mounted, for example, by means of soldering. Thereby, the connecting terminals provided on the FPC inserted in the housing 11 are electrically connected through the conductive contacts 13 with the signal terminals provided on the solid circuit board on which the housing 11 is mounted.

The electrical connector 10 has also a shell member 14 mounted on the housing 11 for covering an outer surface of the housing 11 except the front end portion 11*a* surrounding the opening 12, a major part of the rear end portion 11*b*, a part of the upper plate-shaped portion 11*c*, a part of the lower plate-shaped portion 11*d* and a part of each of left and right side end portions of the housing 11. That is, the shell member 14 is provided for covering partially the housing 11 and a major part of the upper plate-shaped portion 11*c*, a major part of the lower plate-shaped portion 11*d* and a major part of each of the left and right side end portions of the housing 11 is covered by the shell member 14.

The shell member 14 is formed by means of processing a resilient metal thin plate and grounded to be operative to contribute to adjustment on characteristic impedance of each of the conductive contacts 13 and to shield the conductive contacts 13 arranged on the housing 11 from electromagnetic wave noises coming from the outside.

Figure 7:
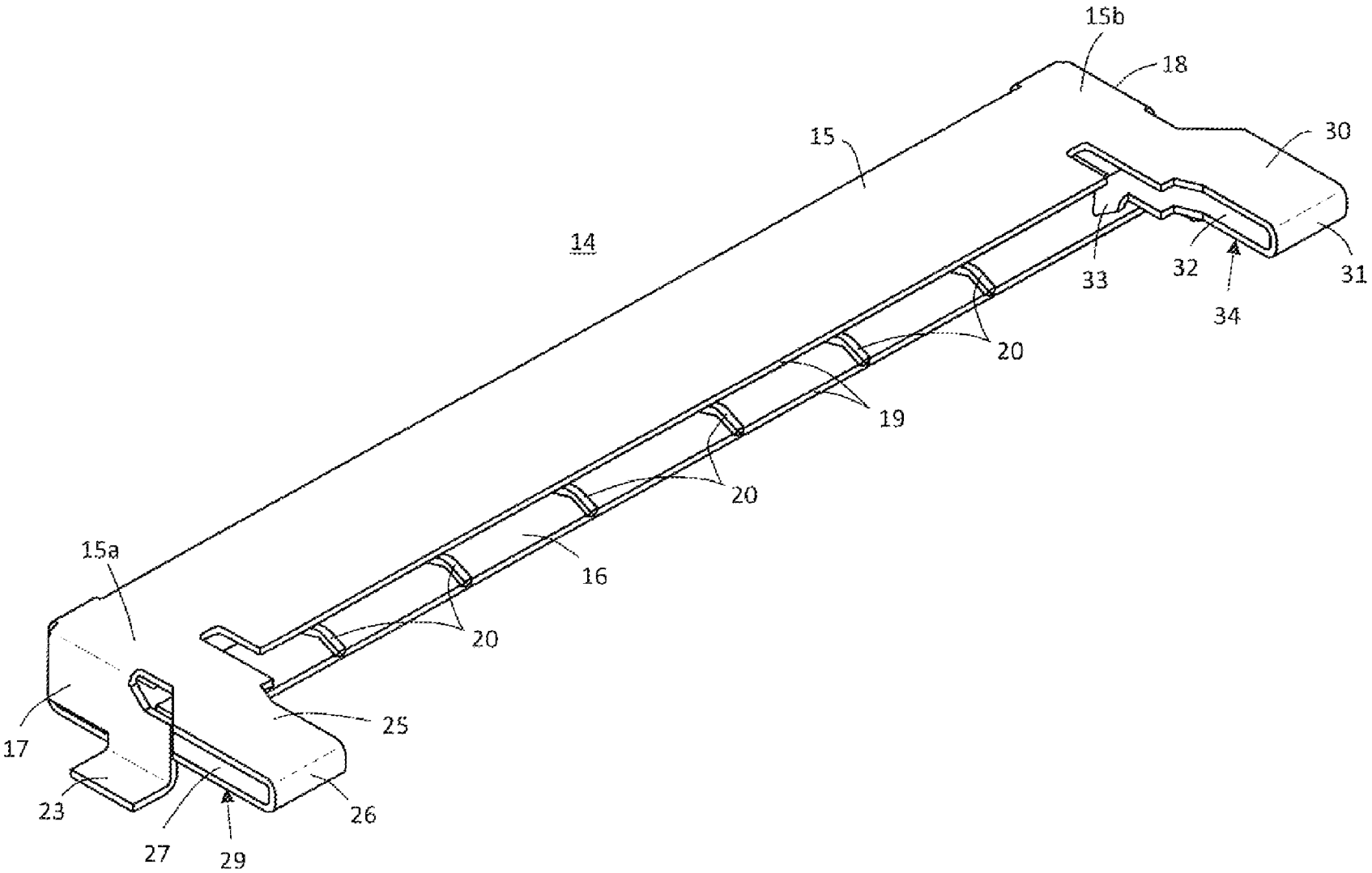
FIG. 7 is a schematic front, top and left side perspective view showing a shell member provided to be employed in the first embodiment shown in each of FIGS. 1 and 2.
Figure 8:
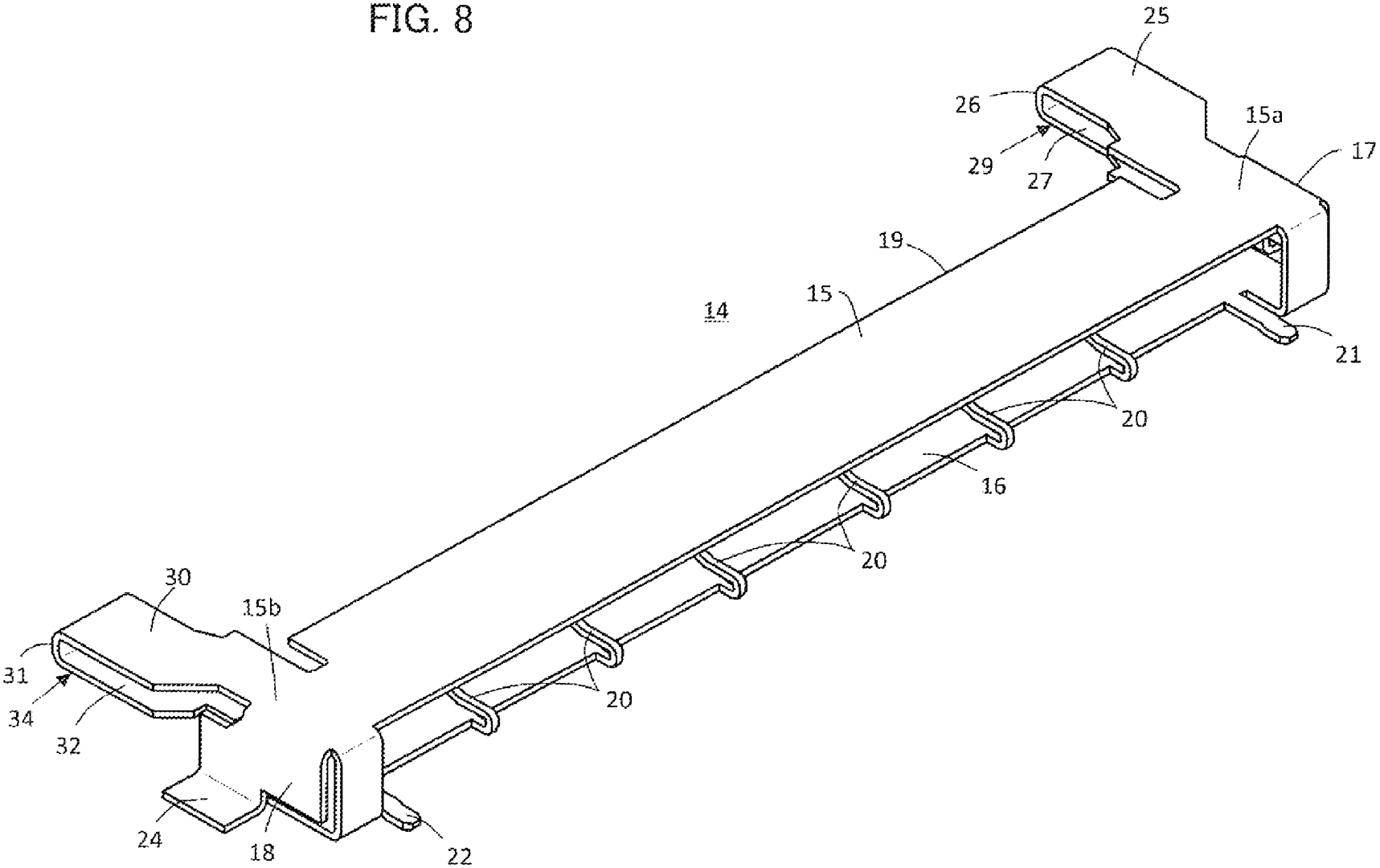
FIG. 8 is a schematic rear, top and right side perspective view showing the shell member shown in FIG. 7.

As shown in FIG. 7 which is a schematic front, top and left side perspective view showing the shell member 14 and FIG. 8 which is a schematic rear, top and right side perspective view showing the shell member 14, the shell member 14 is provided with an upper portion 15 for covering the major part of the upper plate-shaped portion 11*c* of the housing 11, a lower portion 16 for covering the part of the lower plate-shaped portion 11*d* of the housing 11, a left side portion 17 for covering the major part of the left side end portion of the housing 11, a right side portion 18 for covering the major part of the right side end portion of the housing 11, and a front portion 19 for forming an opening.

The lower portion 16 of the shell member 14 is provided with a plurality of grounding contacts 20, each of which extends from a rear end portion opposite to the front portion 19 of the shell member 14 to be bent into an inside of the shell member 14 toward the front portion 19 of the shell member 14, as shown in FIG. 8. Each of the grounding contacts 20 is operative to come into contact with a ground connecting portion provided on the FPC inserted in the housing 11 through the opening 12 provided thereon from the side of the lower portion 16 of the shell member 14. The lower portion 16 of the shell member 14 is further provided at its portions close to the left and right side portions 17 and 18 with board connecting portions 21 and 22, each of which extends from the lower portion 16 of the shell member 14 toward the outside of the rear end portion of the shell member 14. The left and right side portions 17 and 18 of the shell member 14 are provided respectively with board connecting portions 23 and 24. The board connecting portion 23 extends from the left side portion 17 of the shell member 14 toward the outside of the same and the board connecting portion 24 extends from the right side portions 18 of the shell member 14 toward the outside of the same. Each of the board connecting portions 21 to 24 is electrically connected with a grounded portion provided on the solid circuit board on which the housing 11 is mounted, for example, by means of soldering.

With the grounding contacts 20 and the board connecting portions 21 to 24 thus provided on the shell member 14, the ground connecting portion provided on the FPC inserted in the housing 11 is electrically connected through the shell member 14 with the grounded portion provided on the solid circuit board on which the housing 11 is mounted. Each of the board connecting portions 21 to 24 is operative to supply the shell member 14 with a ground potential from the solid circuit board and to be used for mounting the housing 11 on the solid circuit board.

Figure 9:
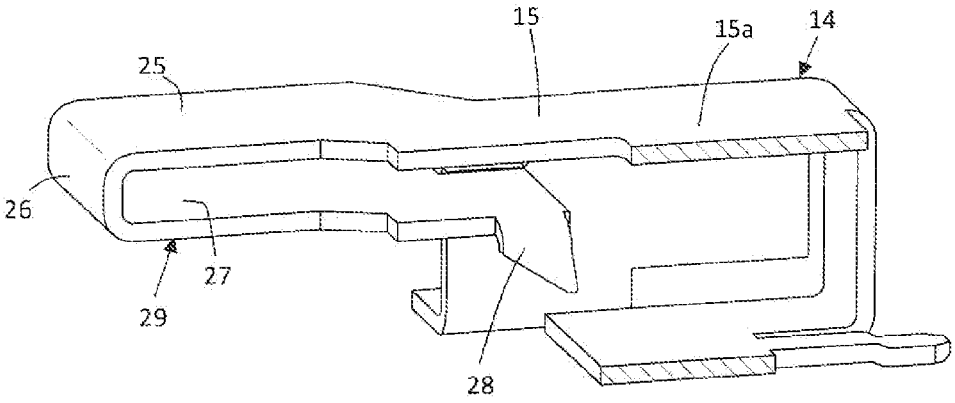
FIG. 9 is a schematic partial perspective view including a partial cross section, which shows an end portion of the shell member shown in each of FIGS. 7 and 8.

As shown clearly in FIGS. 7, 8 and 9, the shell member 14 is also provided with a releasing portion 25 extending to the outside of the front portion 19 of the shell member 14, a connecting portion 26 extending to be bent downward from the releasing portion 25, and a holding portion 29 constituted with a cantilever arm 27 extending to be bent to the front portion 19 of the shell member 14 from the connecting portion 26 and an engaging projection 28 formed at an end of the cantilever arm 27. The releasing portion 25, the connecting portion 26 and the holding portion 29 are formed in a body in the shell member 14.

The releasing portion 25 is provided for extending to the outside of the front end portion 11*a* of the housing 11 from an end portion 15*a* of the upper portion 15 of the shell member 14 on the side of the left side portion 17 of the shell member 14 which covers a left end portion of the upper plate-shaped portion 11*c* of the housing 11. The connecting portion 26 is provided for extending from the releasing portion 25 toward the lower plate-shaped portion 11*d* of the housing 11 in a direction perpendicular to the longitudinal direction of the housing 11 along which the conductive contacts 13 are arranged. The cantilever arm 27 of the holding portion 29 is provided for extending from the connecting portion 26 into the housing 11 so as to put the engaging projection 28 in the inside of the opening 12 provided on the housing 11. A folded-back protrusion formed in a body in the shell member 14 is constituted with the releasing portion 25, the connecting portion 26 and the holding portion 29.

As shown clearly in FIGS. 7 and 8, the shell member 14 is further provided with a releasing portion 30 extending to the outside of the front portion 19 of the shell member 14, a connecting portion 31 extending to be bent downward from the releasing portion 30, and a holding portion 34 constituted with a cantilever arm 32 extending to be bent to the front portion 19 of the shell member 14 from the connecting portion 31 and an engaging projection 33 formed at an end of the cantilever arm 32. The releasing portion 30, the connecting portion 31 and the holding portion 34 are formed in a body in the shell member 14.

The releasing portion 30 is provided for extending to the outside of the front end portion 11*a* of the housing 11 from an end portion 15*b* of the upper portion 15 of the shell member 14 on the side of the right side portion 18 of the shell member 14 which covers a right end portion of the upper plate-shaped portion 11*c* of the housing 11. The connecting portion 31 is provided for extending from the releasing portion 30 toward the lower plate-shaped portion 11*d* of the housing 11 in the direction perpendicular to the longitudinal direction of the housing 11 along which the conductive contacts 13 are arranged. The cantilever arm 32 of the holding portion 34 is provided for extending from the connecting portion 31 into the housing 11 so as to put the engaging projection 33 in the inside of the opening 12 provided on the housing 11. A folded-back protrusion formed in a body in the shell member 14 is constituted with the releasing portion 30, the connecting portion 31 and the holding portion 34.

Each of the holding portion 29 and the holding portion 34 formed in a body in the shell member 14 is operative to be put in engagement with the FPC inserted in the housing 11 to hold the same. Each of the releasing portion 25 and the releasing portion 30 formed also in a body in the shell member 14 is operative to release each of the holding portion 29 and the holding portion 34 from the engagement with the FPC inserted in the housing 11. When the releasing portion 25 is manipulated, for example, with pressure directed toward the holding portion 29, the releasing portion 25 operates to release the holding portion 29 from the engagement with the FPC inserted in the housing 11, and when the releasing portion 30 is manipulated, for example, with pressure directed toward the holding portion 34, the releasing portion 30 operates to release the holding portion 34 from the engagement with the FPC inserted in the housing 11. The connecting portion 26 is provided for connecting the holding portion 29 with the releasing portion 25 and the connecting portion 31 is provided for connecting the holding portion 34 with the releasing portion 30.

The engagement of the holding portion 29 of the shell member 14 with the FPC is obtained in such a manner that the engaging projection 28 of the holding portion 29 engages with an engaging portion provided on the FPC inserted into the housing 11 through the opening 12 provided thereon and similarly the engagement of the holding portion 34 of the shell member 14 with the FPC is obtained in such a manner that the engaging projection 33 of the holding portion 34 engages with an engaging portion provided on the FPC inserted into the housing 11 through the opening 12 provided thereon.

Each of the releasing portions 25 and 30 and the holding portions 29 and 34 formed in a body in the shell member 14 which is formed by means of processing the resilient metal thin plate, constitutes a resilient movable portion. The cantilever arm 27 of the holding portion 29 is operative to swing with a fulcrum placed at a root of the holding portion 29 connected with the connecting portion 26. Similarly, the cantilever arm 32 of the holding portion 34 is operative to swing with a fulcrum placed at a root of the holding portion 34 connected with the connecting portion 31. The releasing portion 25 is operative to swing with a fulcrum placed at a root of the releasing portion 25 connected with the end portion 15*a* of the upper portion 15 of the shell member 14. Similarly, the releasing portion 30 is operative to swing with a fulcrum placed at a root of the releasing portion 30 connected with the end portion 15*b* of the upper portion 15 of the shell member 14.

Figure 10:
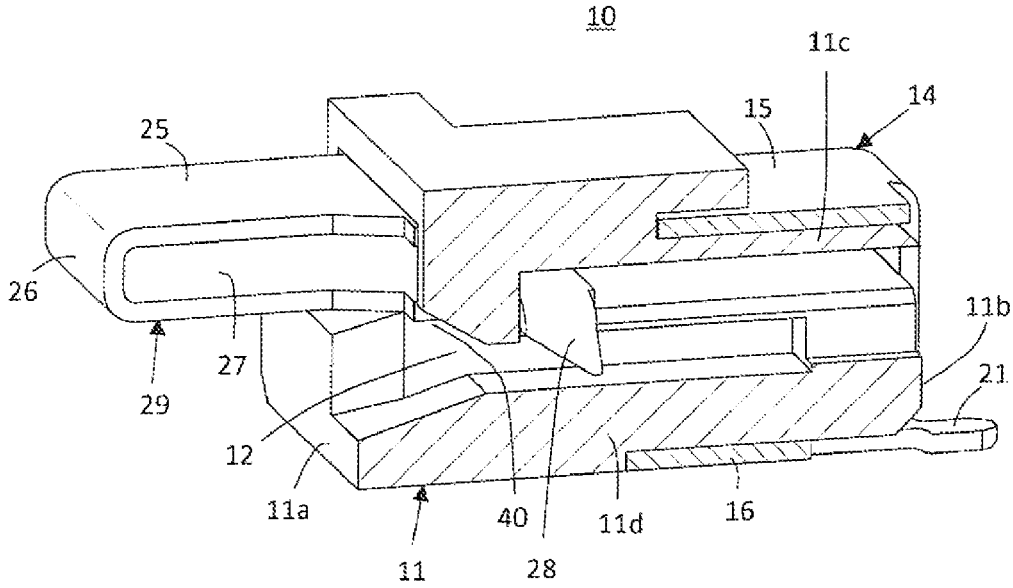
FIG. 10 is a schematic partial perspective view including partial cross sections and used for explaining a holding portion, a connecting portion and a releasing portion employed in the first embodiment shown in each of FIGS. 1 and 2.

As shown in FIG. 6 and FIG. 10 which is a schematic partial perspective view including partial cross sections and showing a left end portion of the electrical connector 10, when the releasing portion 25 is not manipulated with the pressure directed toward the holding portion 29, the holding portion 29 is operative to cause the cantilever arm 27 to come into contact with a positioning portion 40 provided on the housing 11 so as to be restricted in its position thereby and to put the engaging projection 28 formed at the end of the cantilever arm 27 in the inside of the opening 12 provided on the housing 11. Then, when the FPC is inserted into the housing 11 through the opening 12 provided thereon under a condition wherein the engaging projection 28 formed at the end of the cantilever arm 27 is put in the inside of the opening 12, the engaging projection 28 of the holding portion 29 engages with the engaging portion provided on the FPC inserted in the housing 11 so that the FPC is held by the holding portion 29.

Figure 11:
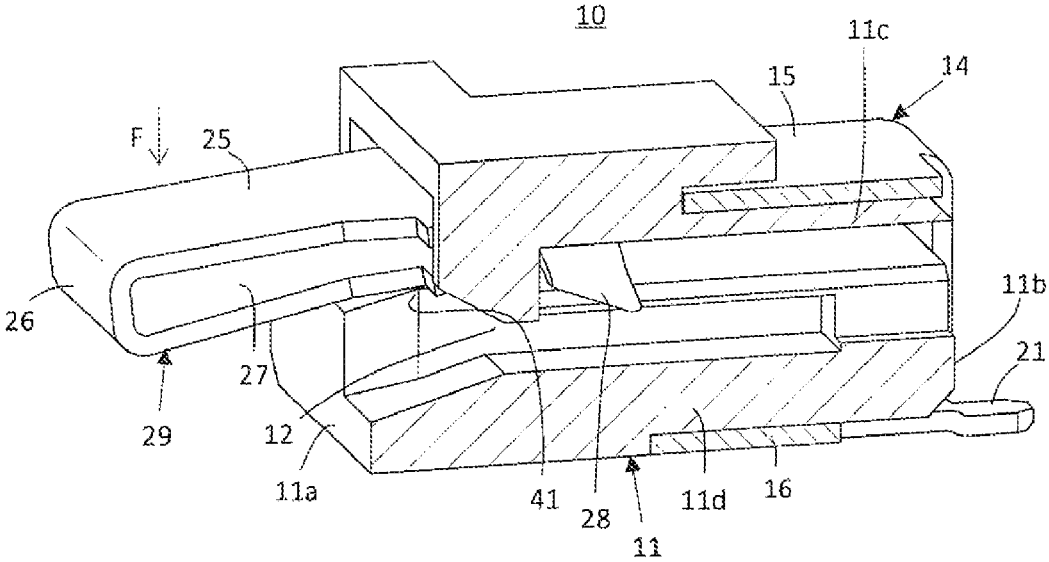
FIG. 11 is a schematic partial perspective view including partial cross sections and used for explaining a holding portion, a connecting portion and a releasing portion employed in the first embodiment shown in each of FIGS. 1 and 2.

On the other hand, as shown in FIG. 11 which is also a schematic partial perspective view including partial cross sections and showing the left end portion of the electrical connector 10, when the releasing portion 25 is manipulated with the pressure directed toward the holding portion 29 as indicated by an arrow F, the releasing portion 25 swings with the fulcrum placed at the root of the releasing portion 25 connected with the end portion 15*a* of the upper portion 15 of the shell member 14 and therewith the holding portion 29 swings with the fulcrum placed at the root of the holding portion 29 connected with the connecting portion 26 under a condition wherein the cantilever arm 27 of the holding portion 29 is in contact with a contacting portion 41 provided on the housing 11 and moves the engaging projection 28 formed at the end of the cantilever arm 27 to approach to the root of the releasing portion 25 connected with the end portion 15*a* of the upper portion 15 of the shell member 14 so that the engaging projection 28 goes away from the inside of the opening 12 provided on the housing 11. Under a condition wherein the holding portion 29 causes the engaging projection 28 formed at the end of the cantilever arm 27 to go away from the inside of the opening 12 provided on the housing 11, the engaging projection 28 does not engage with the engaging portion provided on the FPC inserted in the housing 11. Accordingly, when the releasing portion 25 is manipulated with the pressure directed toward the holding portion 29 under the condition wherein the holding portion 29 is put in the engagement with the FPC inserted in the housing 11 for holding the same, the FPC is released from the holding by the holding portion 29.

Similarly, when the releasing portion 30 is not manipulated with the pressure directed toward the holding portion 34, the holding portion 34 is operative to cause the cantilever arm 32 to come into contact with a positioning portion provided on the housing 11 so as to be restricted in its position thereby and to put the engaging projection 33 formed at the end of the cantilever arm 32 in the inside of the opening 12 provided on the housing 11. Then, when the FPC is inserted into the housing 11 through the opening 12 provided thereon under a condition wherein the engaging projection 33 formed at the end of the cantilever arm 32 is put in the inside of the opening 12, the engaging projection 33 of the holding portion 29 engages with the engaging portion provided on the FPC inserted in the housing 11 so that the FPC is held by the holding portion 34.

On the other hand, when the releasing portion 30 is manipulated with the pressure directed toward the holding portion 34, the releasing portion 30 swings with the fulcrum placed at the root of the releasing portion 30 connected with the end portion 15*b* of the upper portion 15 of the shell member 14 and therewith the holding portion 34 swings with the fulcrum placed at the root of the holding portion 34 connected with the connecting portion 31 under a condition wherein the cantilever arm 32 of the holding portion 34 is in contact with a contacting portion provided on the housing 11 and moves the engaging projection 33 formed at the end of the cantilever arm 32 to approach to the root of the releasing portion 30 connected with the end portion 15*b* of the upper portion 15 of the shell member 14 so that the engaging projection 33 goes away from the inside of the opening 12 provided on the housing 11. Under a condition wherein the holding portion 34 causes the engaging projection 33 formed at the end of the cantilever arm 32 to go away from the inside of the opening 12 provided on the housing 11, the engaging projection 33 does not engage with the engaging portion provided on the FPC inserted in the housing 11. Accordingly, when the releasing portion 30 is manipulated with the pressure directed toward the holding portion 34 under the condition wherein the holding portion 34 is put in the engagement with the FPC inserted in the housing 11 for holding the same, the FPC is released from the holding by the holding portion 34.

Figure 12:
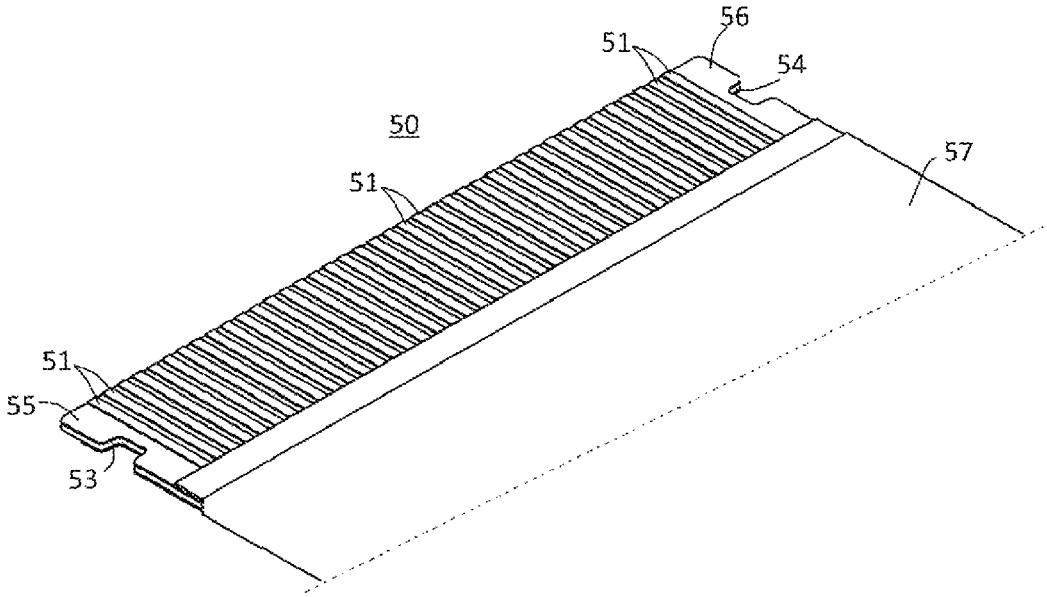
FIG. 12 is a schematic partial perspective view showing a part of an FPC which is to be inserted into a housing of the first embodiment shown in each of FIGS. 1 and 2.

FIG. 12 shows an FPC 50 which is an example of the FPC constituting the flat circuit device to be inserted into the housing 11 of the electrical connector 10 through the opening 12 provided on the housing 11.

Referring to FIG. 12, a plurality of connecting terminals 51 each made of conductive material and formed into a rectangular plate member are provided on a first surface opposite to a second surface of the FPC 50 to be arranged at an end portion of the first surface. Although an illustrational explanation is omitted, a ground connecting portion is also provided on the second surface of the FPC 50. Further, a pair of engaging edged recesses 53 and 54 each constituting an engaging portion are provided respectively on side end portions of the FPC 50 which are opposite each other with the connecting terminals 51 between. A top flat portion 55 is formed at the outside of the engaging edged recess 53 provided on one of the side end portions of the FPC 50 and another top flat portion 56 is formed at the outside of the engaging edged recess 54 provided on the other of the side end portions of the FPC 50.

It is possible to provide the FPC 50 with a pair of engaging edged holes as engaging portions in place of the engaging edged recesses 53 and 54. The FPC 50 is wrapped with a covering film 57 except a portion thereof on which the connecting terminals 51, the ground connecting portion, the engaging edged recesses 53 and 54 and the top flat portions 55 and 56 are provided.

Figure 13:
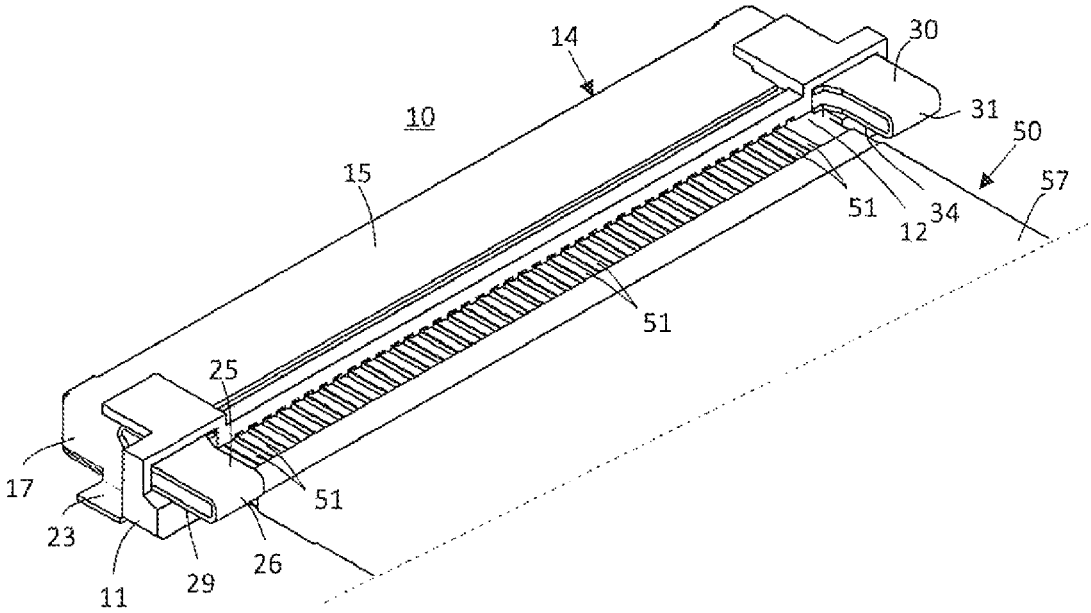
FIG. 13 is a schematic perspective view showing a situation wherein the FPC has been inserted in the first embodiment shown in each of FIGS. 1 and 2.
Figure 14:
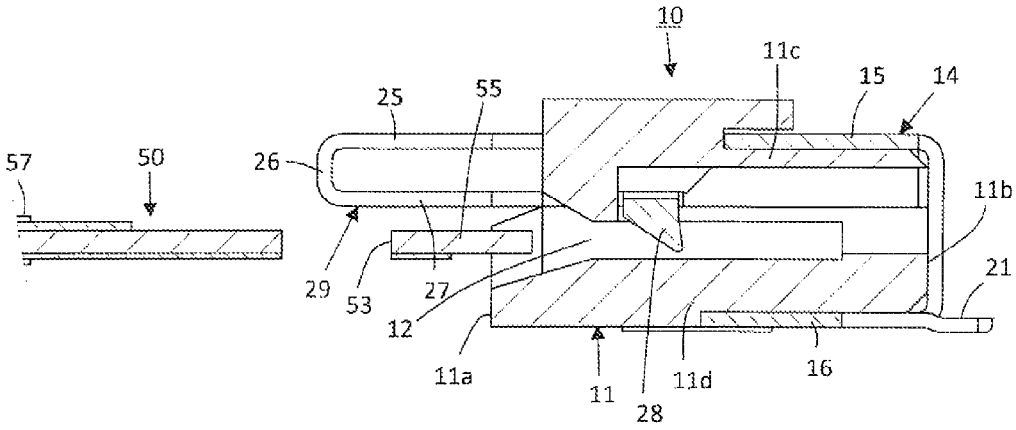
FIG. 14 is a schematic partial cross sectional view showing a situation wherein the FPC is positioned to be inserted into the first embodiment shown in each of FIGS. 1 and 2.

FIG. 13 shows the electrical connector 10 and the FPC 50 which is inserted in the housing 11 of the electrical connector 10 through the opening 12 provided on the housing 11. In FIG. 14, the first surface of the FPC 50, on which the connecting terminals 51 are provided, faces upward to appear on the side of the upper portion 15 of the shell member 14, and the second surface of the FPC 50, on which the ground connecting portion is provided, faces downward to be not shown. A top end of a part of the FPC 50 on which the connecting terminals 51 are provided is postured to be parallel with the rear end portion 11*b* of the housing 11 in a condition wherein the FPC 50 is properly inserted into the housing 11 through the opening 12 provided thereon.

On the way to a condition wherein the FPC 50 is inserted in the housing 11 of the electrical connector 10 through the opening 12 provided on the housing 11 as shown in FIG. 13, first the top end of the part of the FPC 50 on which the connecting terminals 51 are provided is placed to face the opening 12 provided on the front end portion 11*a* of the housing 11 of the electrical connector 10 under the condition wherein the releasing portion 25 is not manipulated with the pressure directed toward the holding portion 29, as shown in FIG. 14. On that occasion, the top flat portion 55 and the engaging edged recess 53 of the FPC 50 are positioned to correspond to the holding portion 29 of the electrical connector 10 in such a manner as shown in FIG. 14 and the top flat portion 56 and the engaging edged recess 54 of the FPC 50 are positioned to correspond to the holding portion 34 of the electrical connector 10.

Figure 15:
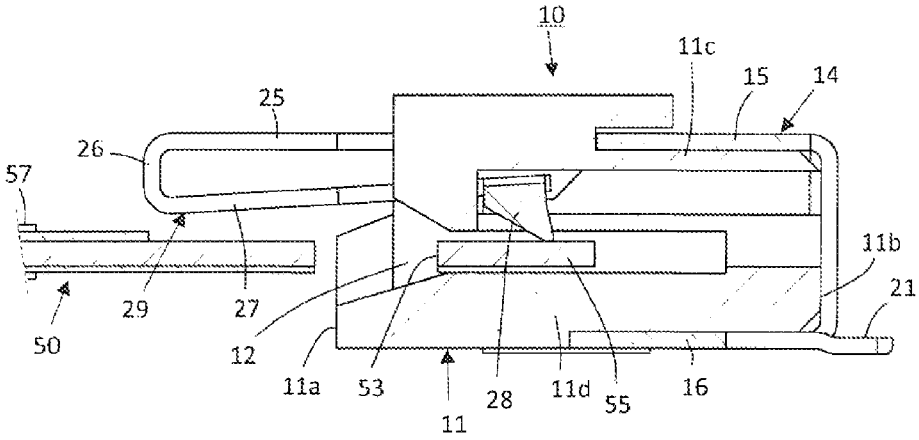
FIG. 15 is a schematic partial cross sectional view showing a situation wherein the FPC is on the way to complete insertion into the first embodiment shown in each of FIGS. 1 and 2.

Then, as shown in FIG. 15, the FPC 50 is inserted into the housing 11 through the opening 12 provided on the front end portion 11*a* of the housing 11 with the top end thereof facing the rear end portion 11*b* of the housing 11 and the first surface of the FPC 50 facing upward. With the FPC 50 inserted continuously into the housing 11, the top flat portion 55 formed at the outside of the engaging edged recess 53 of the FPC 50 comes into contact with the engaging projection 28 formed at the end of the cantilever arm 27 of the holding portion 29 and thereby move the engaging projection 28 to approach to the end portion 15*a* of the upper portion 15 of the shell member 14. With the movement of the engaging projection 28 thus performed, the cantilever arm 27 of the holding portion 29 swings with the fulcrum placed at the root of the holding portion 29 connected with the connecting portion 26 so as to move the engaging projection 28 of the holding portion 29 to go away from the inside of the opening 12 provided on the housing 11. As a result, the FPC 50 inserted continuously into the housing 11 is not disturbed by the engaging projection 28 formed at the end of the cantilever arm 27 of the holding portion 29.

Similarly, with the FPC 50 inserted continuously into the housing 11, the top flat portion 56 formed at the outside of the engaging edged recess 54 of the FPC 50 comes into contact with the engaging projection 33 formed at the end of the cantilever arm 32 of the holding portion 34 and thereby move the engaging projection 33 to approach to the end portion 15*b* of the upper portion 15 of the shell member 14. With the movement of the engaging projection 33 thus performed, the cantilever arm 32 of the holding portion 34 swings with the fulcrum placed at the root of the holding portion 34 connected with the connecting portion 31 so as to move the engaging projection 33 of the holding portion 34 to go away from the inside of the opening 12 provided on the housing 11. As a result, the FPC 50 inserted continuously into the housing 11 is not disturbed by the engaging projection 33 formed at the end of the cantilever arm 32 of the holding portion 34.

After that, the FPC 50 is further inserted into the housing 11 to reach a predetermined appropriate position in the housing 11. When the FPC 50 has reached the predetermined appropriate position in the housing 11, the insertion of the FPC 50 into the housing 11 is completed.

Figure 16:
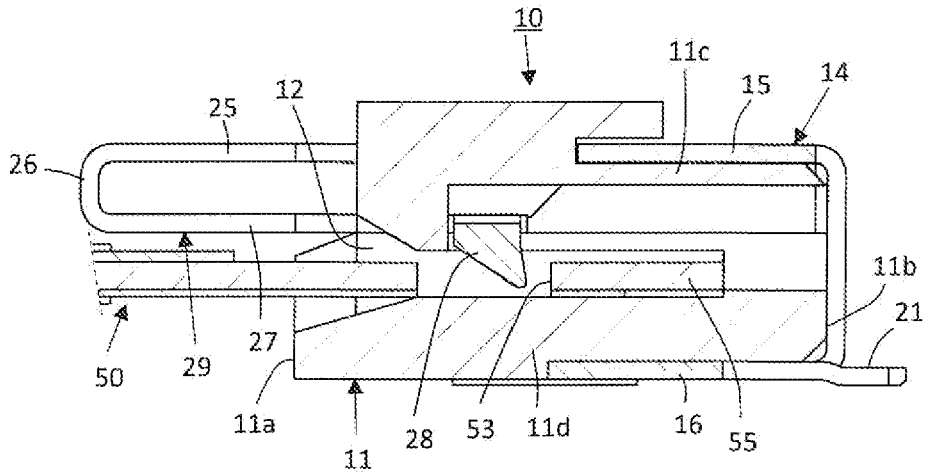
FIG. 16 is a schematic partial cross sectional view showing a situation wherein the FPC has been correctly inserted into the first embodiment shown in each of FIGS. 1 and 2 to be held by the holding portion of the shell member employed in the first embodiment shown in each of FIGS. 1 and 2.

When the FPC 50 is completely inserted into the housing 11, the engaging projection 28 of the holding portion 29 gets out of the contact with the top flat portion 55 of the FPC 50 and thereby engages with the engaging edged recess 53 provided on the FPC 50, as shown in FIG. 16. Further, although an illustrational explanation is omitted, the engaging projection 33 of the holding portion 34 also gets out of the contact with the top flat portion 56 of the FPC 50 and thereby engages with the engaging edged recess 54 provided on the FPC 50.

On that occasion, the cantilever arm 27 of the holding portion 29 is caused by its own restoring resilient force to swing with the fulcrum placed at the root of the holding portion 29 connected with the connecting portion 26 for getting back to its condition prior to the movement of the engaging projection 28 of the holding portion 29 for going away from the inside of the opening 12 provided on the housing 11 and operative to cause the engaging projection 28 to engage with the engaging edged recess 53 provided on the FPC 50. Similarly, the cantilever arm 32 of the holding portion 34 is caused by its own restoring resilient force to swing with the fulcrum placed at the root of the holding portion 34 connected with the connecting portion 31 for getting back to its condition prior to the movement of the engaging projection 33 of the holding portion 34 for going away from the inside of the opening 12 provided on the housing 11 and operative to cause the engaging projection 33 to engage with the engaging edged recess 54 provided on the FPC 50.

As a result, the holding portions 29 and 34 are put in the engagement with the FPC 50 inserted in the housing 11 for holding the same, so that the FPC 50 is prevented from getting out of the housing 11 unwillingly.

Under a condition wherein the FPC 50 inserted in the housing 11 through the opening 12 provided thereon takes up the predetermined appropriate position in the housing 11 so as to be held by each of the holding portions 29 and 34 in such a manner as described above, the press-contacting portion 13*a* of each of the conductive contacts 13 arranged on the housing 11 comes into press-contact with a corresponding one of the connecting terminals 51 provided on the FPC 50, which is inserted in the housing 11 with the first surface thereof provided thereon with the connecting terminals 51 facing upward, from the side of the upper portion 15 of the shell member 14. As a result, the connecting terminals 51 provided on the FPC 50 inserted in the housing 11 are electrically connected through the conductive contacts 13 with the signal terminals provided on the solid circuit board on which the housing 11 is mounted.

Further, each of the grounding contacts 20 extending from the rear end portion of the shell member 14 to be bent into the inside of the opening 12 provided on the housing 11 comes into contact with the ground connecting portion provided on the second surface of the FPC 50 inserted in the housing 11 from the side of the lower portion 16 of the shell member 14. As a result, the ground connecting portion provided on the FPC 50 inserted in the housing 11 is electrically connected through the grounding contacts 20 with the grounded portion provided on the solid circuit board on which the housing 11 is mounted.

Figure 17:
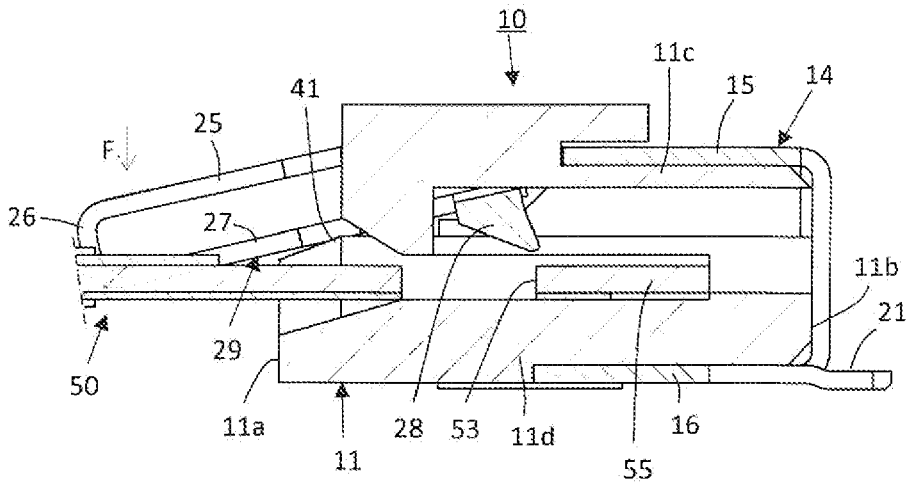
FIG. 17 is a schematic partial cross sectional view showing a situation wherein the releasing portion of the shell member employed in the first embodiment shown in each of FIGS. 1 and 2 causes the holding portion to release the FPC inserted in the first embodiment shown in each of FIGS. 1 and 2 from holding by the holding portion.

After that, as shown in FIG. 17, when the releasing portion 25 is manipulated with the pressure directed toward the holding portion 29 as indicated by an arrow F in FIG. 17, the releasing portion 25 swings with the fulcrum placed at the root of the releasing portion 25 connected with the end portion 15*a* of the upper portion 15 of the shell member 14 and therewith the cantilever arm 27 of the holding portion 29 swings with the fulcrum placed at the root of the holding portion 29 connected with the connecting portion 26 under a condition wherein the cantilever arm 27 is in contact with the contacting portion 41 provided on the housing 11 and moves the engaging projection 28 formed at the end of the cantilever arm 27 to approach to the root of the releasing portion 25 connected with the end portion 15*a* of the upper portion 15 of the shell member 14 so that the engaging projection 28 goes away from the inside of the opening 12 provided on the housing 11. Under the condition wherein the holding portion 29 causes the engaging projection 28 formed at the end of the cantilever arm 27 to go away from the inside of the opening 12 provided on the housing 11, the engaging projection 28 does not engage with the engaging portion provided on the FPC 50 inserted in the housing 11 so that the FPC 50 is released from the holding by the holding portion 29.

Similarly, when the releasing portion 30 is manipulated with the pressure directed toward the holding portion 34, the releasing portion 30 swings with the fulcrum placed at the root of the releasing portion 30 connected with the end portion 15*b* of the upper portion 15 of the shell member 14 and therewith the cantilever arm 32 of the holding portion 34 swings with the fulcrum placed at the root of the holding portion 34 connected with the connecting portion 31 under a condition wherein the cantilever arm 32 is in contact with the contacting portion provided on the housing 11 and moves the engaging projection 33 formed at the end of the cantilever arm 32 to approach to the root of the releasing portion 30 connected with the end portion 15*b* of the upper portion 15 of the shell member 14 so that the engaging projection 33 goes away from the inside of the opening 12 provided on the housing 11. Under the condition wherein the holding portion 34 causes the engaging projection 33 formed at the end of the cantilever arm 32 to go away from the inside of the opening 12 provided on the housing 11, the engaging projection 33 does not engage with the engaging portion provided on the FPC 50 inserted in the housing 11 so that the FPC 50 is released from the holding by the holding portion 34.

When the FPC 50 inserted in the housing 11 is released from the holding by each of the holding portions 29 and 34 in such a manner as mentioned above, the FPC 50 inserted in the housing 11 is put in a condition to be caused intentionally to get out of the housing 11.

In the electrical connector 10 thus constituted as the embodiment of electrical connector according to the present invention, as described above, when the FPC 50 is inserted into the housing 11 through the opening 12 provided thereon, the press-contacting portion 13*a* of each of the conductive contacts 13 arranged on the housing 11 comes into contact with the corresponding one of the connecting terminals 51 provided on the FPC 50 inserted in the housing 11 and each of the holding portions 29 and 34 formed in a body in the shell member 14 is put in the engagement with the FPC 50 inserted in the housing 11 for holding the same. As a result, the FPC 50 inserted in the housing 11 is held by the holding portions 29 and 34 so as to be surely prevented from getting out of the housing 11 unwillingly and the conductive contacts 13 arranged on the housing 11 are stably kept in electrical connection with the connecting terminals 51 provided on the FPC 50 inserted in the housing 11.

Then, when each of the releasing portions 25 and 30, which are also formed in a body in the shell member 14 in addition to the holding portions 29 and 34, is manipulated to release each of the holding portions 29 and 34 from the engagement with the FPC 50 inserted in the housing 11 under the condition wherein the FPC 50 inserted in the housing 11 is put in the holding by each of the holding portions 29 and 34, the releasing portion 25 is moved to shift the holding portion 29 through the connecting portion 26 so that the holding portion 29 is released from the engagement with the FPC 50 inserted in the housing 11 and the releasing portion 30 is moved to shift the holding portion 34 through the connecting portion 31 so that the holding portion 34 is released from the engagement with the FPC 50 inserted in the housing 11.

As a result, the FPC 50 inserted in the housing 11 is released from the holding by each of the holding portions 29 and 34 so as to be able to get out of the housing 11.

Accordingly, with the electrical connector 10, the FPC 50 inserted in the housing 11 can be put in the holding by the holding portions 29 and 34 formed in a body in the shell member 14 to be surely prevented from getting out of the housing 11 unwillingly and then released from the holding by the holding portions 29 and 34 to be able to get out of the housing 11 with an improved structure with which the electrical connector 10 can be miniaturized on the whole and the number of structural parts can be reduced.

Further, since the releasing portion 25, the connecting portion 26 and the holding portion 29 constitutes the folded-back protrusion formed in a body in the shell member 14 and the releasing portion 30, the connecting portion 31 and the holding portion 34 constitutes also the folded-back protrusion formed in a body in the shell member 14, the holding portion 29 can be shifted in its position on a relatively large scale through the connecting portion 26 with a relatively small-scale movement of the releasing portion 25 caused by the manipulation inflicted on the releasing portion 25 and the holding portion 34 can be shifted in its position on a relatively large scale through the connecting portion 31 with a relatively small-scale movement of the releasing portion 30 caused by the manipulation inflicted on the releasing portion 30. As a result, the FPC 50 inserted in the housing 11 can be released from the holding by the holding portions 29 and 34 with an improved structure in which the releasing portions 25 and 30, the connecting portions 26 and 31 and the holding portions 29 and 34 can be miniaturized on the whole.

In addition, since the releasing portion 25 of the shell member 14 is manipulated with the pressure directed toward the holding portion 29 of the shell member 14, which is put in engagement with the FPC 50 inserted in the housing 11 to hold the same, for releasing the holding portion 29 from the engagement with the FPC 50 and the releasing portion 30 of the shell member 14 is also manipulated with the pressure directed toward the holding portion 34 of the shell member 14, which is put in engagement with the FPC 50 inserted in the housing 11 to hold the same, for releasing the holding portion 34 from the engagement with the FPC 50, the FPC 50 inserted in the housing 11 can be surely released from the holding by the holding portions 29 and 34 by means of a quite simple and easy manipulation on the releasing portions 25 and 30 of the shell member 14.

Incidentally, although the FPC 50 is inserted in the housing 11 with the first surface thereof provided thereon with the connecting terminals 51 and facing upward under a condition wherein the press-contacting portion 13*a* of each of the conductive contacts 13, which is provided for coming into press-contact with the connecting terminal 51 on the first surface of the FPC 50, is arranged to project into the inside of the opening 12 provided on the housing 11 from the side of the upper portion 15 of the shell member 14, in the electrical connector 10 described above, it is also possible to modify the electrical connector 10 in such a manner that the FPC 50 is inserted in the housing 11 with the first surface thereof provided thereon with the connecting terminals 51 and facing downward under a condition wherein the press-contacting portion 13*a* of each of the conductive contacts 13, which is provided for coming into press-contact with the connecting terminal 51 on the first surface of the FPC 50, is arranged to project into the inside of the opening 12 provided on the housing 11 from the side of the lower portion 16 of the shell member 14.

Figure 18:
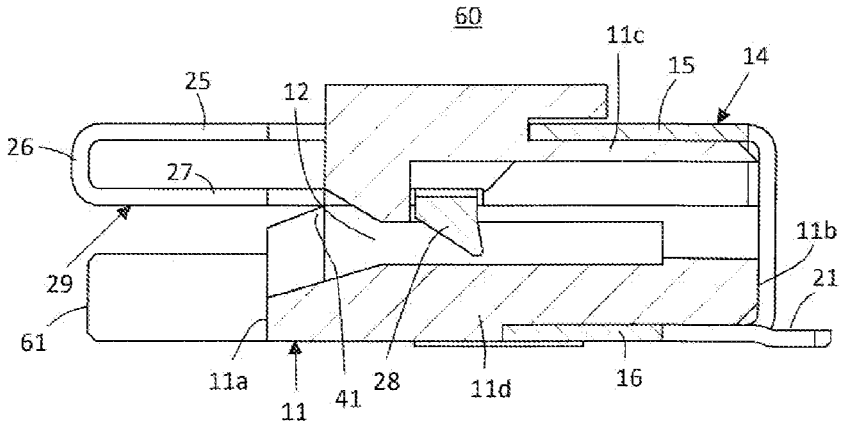
FIG. 18 is a schematic cross sectional view showing a second embodiment of electrical connector according to the present invention.

Further, although a group of the releasing portion 25, the connecting portion 26 and the holding portion 29 formed in a body in the shell member 14 and a group of the releasing portion 30, the connecting portion 31 and the holding portion 34 formed in a body in the shell member 14 are provided on the side of the front end portion 11*a* of the housing 11 and each of the holding portions 29 and 34 extends from the outside of the front end portion 11*a* of the housing 11 into the inside of the housing 11, in the electrical connector 10 described above, it is further possible to modify the electrical connector 10 in such a manner that the group of the releasing portion 25, the connecting portion 26 and the holding portion 29 formed in a body in the shell member 14 and the group of the releasing portion 30, the connecting portion 31 and the holding portion 34 formed in a body in the shell member 14 are provided on the side of the rear end portion 11*b* of the housing 11 and each of the holding portions 29 and 34 extends from the outside of the rear end portion 11*b* of the housing 11 into the inside of the housing 11, FIG. 18 shows a part of an electrical connector 60 which constitutes a second embodiment of electrical connector according to the present invention.

The electrical connector 60 shown in FIG. 18 has various members, portions and parts corresponding to those in the electrical connector 10 constituting the first embodiment of electrical connector according to the present invention, which are marked with the same references, and further description thereof will be omitted.

In FIG. 18, a cross section of a left end portion of the electrical connector 60 is shown. A housing 11 of the electrical connector 60 is provided with a stopper portion 61 positioned in the vicinity of the left side end portion of the housing 11 and under the folded-back protrusion constituted with the releasing portion 25, the connecting portion 26 and the holding portion 29. The stopper portion 61 projects from the front end portion 11*a* of the housing 11 toward the outside of the same. Between the stopper portion 61 and the holding portion 29 constituting the folded-back protrusion, a predetermined space is formed for allowing downward movements of the releasing portion 25 and the holding portion 29 performed when the releasing portion 25 is manipulated with the pressure directed toward the holding portion 29.

Although an illustrational explanation is omitted, the housing 11 of the electrical connector 60 is also provided with a stopper portion, which corresponds to the stopper portion 61, positioned in the vicinity of the right side end portion of the housing 11 and under the folded-back protrusion constituted with the releasing portion 30, the connecting portion 31 and the holding portion 34. This stopper portion projects also from the front end portion 11*a* of the housing 11 toward the outside of the same. Between the stopper portion positioned in the vicinity of the right side end portion of the housing 11 and the holding portion 34 constituting the folded-back protrusion, a predetermined space is formed for allowing downward movements of the releasing portion 30 and the holding portion 34 performed when the releasing portion 30 is manipulated with the pressure directed toward the holding portion 34.

Figure 19:
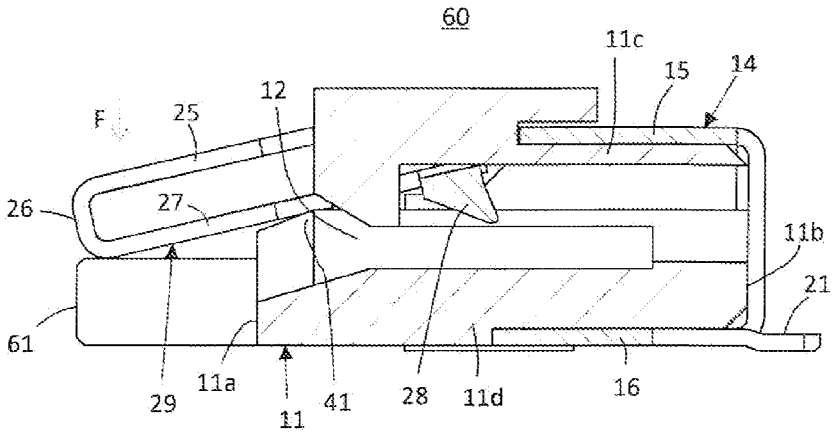
FIG. 19 is a schematic cross sectional view used for explaining the second embodiment shown in FIG. 18.

As shown in FIG. 19, when the releasing portion 25 is manipulated with the pressure directed toward the holding portion 29 as indicated by an arrow F in FIG. 19, so that the releasing portion 25 swings with the fulcrum placed at the root of the releasing portion 25 connected with the end portion 15*a* of the upper portion 15 of the shell member 14 to move downward and therewith the cantilever arm 27 of the holding portion 29 swings with the fulcrum placed at the root of the holding portion 29 connected with the connecting portion 26 under a condition wherein the cantilever arm 27 is in contact with the contacting portion 41 provided on the housing 11 so as to cause the holding portion 29 in its entirety to move downward, the root of the holding portion 29 connected with the connecting portion 26 comes into contact with the stopper portion 61 for preventing the releasing portion 25 and the holding portion 29 from moving further downward after the releasing portion 25 and the holding portion 29 have had predetermined necessary downward movements.

That is, each of the releasing portion 25 and the holding portion 29 is prevented from moving downward excessively by the stopper portion 61 and therefore it is avoided that the folded-back protrusion constituted with the releasing portion 25, the connecting portion 26 and the holding portion 29 is damaged or destroyed.

Similarly, although an illustrational explanation is omitted, when the releasing portion 30 is manipulated with the pressure directed toward the holding portion 34, so that the releasing portion 30 swings with the fulcrum placed at the root of the releasing portion 25 connected with the end portion 15*b* of the upper portion 15 of the shell member 14 to move downward and therewith the cantilever arm 32 of the holding portion 34 swings with the fulcrum placed at the root of the holding portion 34 connected with the connecting portion 31 under a condition wherein the cantilever arm 32 is in contact with the contacting portion provided on the housing 11 so as to cause the holding portion 34 in its entirety to move downward, the root of the holding portion 34 connected with the connecting portion 31 comes into contact with the stopper portion positioned in the vicinity of the right side end portion of the housing 11 for preventing the releasing portion 30 and the holding portion 34 from moving further downward after the releasing portion 30 and the holding portion 34 have had predetermined necessary downward movements.

That is, each of the releasing portion 30 and the holding portion 34 is prevented from moving downward excessively by the stopper portion positioned in the vicinity of the right side end portion of the housing 11 and therefore it is avoided that the folded-back protrusion constituted with the releasing portion 30, the connecting portion 31 and the holding portion 34 is damaged or destroyed.

Other constructional portions of the electrical connector 60 are constituted in the same manner as the electrical connector 10 and the same operations and advantages as the electrical connector 10 can be obtained with the electrical connector 60.

The invention claimed is:

1. An electrical connector comprising:

a housing made of insulator and provided thereon with an opening through which a flat circuit device is inserted into the housing and which opens on one of a pair of opposite end portions of the housing, a plurality of conductive contacts arranged on the housing, each of which has a connecting terminal portion projecting from the other of the pair of opposite end portions of the housing to the outside of the housing and a press-contacting portion positioned in the housing to be operative to come into press-contact with a connecting terminal provided on the flat circuit device inserted in the housing through the opening provided thereon, and a shell member mounted on the housing for covering partially the same and provided in a body therein with a holding portion operative to be put in engagement with the flat circuit device inserted in the housing for holding the same, a releasing portion operative to release the holding portion from the engagement with the flat circuit device inserted in the housing and a connecting portion for connecting the holding portion with the releasing portion, wherein the releasing portion extends to the outside of the housing from a portion of the shell member covering an end portion of one of a pair of opposite plate-shaped portions of the housing which face each other with the opening provided on the housing between, the connecting portion extends to be bent from the releasing portion toward the other of the pair of opposite plate-shaped portions of the housing in a direction perpendicular to a direction along which the conductive contacts are arranged, and the holding portion is constituted with a cantilever arm extending to be bent from the connecting portion into the housing and an engaging projection formed at an end of the cantilever arm, so that a folded-back protrusion formed in a body in the shell member is constituted with the releasing portion, the connecting portion and the holding portion.

2. An electrical connector according to claim 1, wherein each of the holding portion and the releasing portion constitutes a resilient movable portion.

3. An electrical connector according to claim 2, wherein the engaging projection of the holding portion is operative to engage with an engaging portion provided on the flat circuit device inserted in the housing, the cantilever arm of the holding portion is operative to swing with a fulcrum placed at a root of the holding portion connected with the connecting portion, and the releasing portion swings with a fulcrum placed at a root of the releasing portion connected with the shell member when the releasing portion is manipulated with pressure directed toward the holding portion.

4. An electrical connector according to claim 3, wherein the holding portion is operative to cause the cantilever arm to come into contact with a positioning portion provided on the housing so that the holding portion in its entirety is restricted in position thereby when the releasing portion is not manipulated with the pressure directed toward the holding portion and operative to cause the cantilever arm to come into contact with a contacting portion provided on the housing and move the engaging projection formed at the end of the cantilever arm to approach to the root of the releasing portion connected with the shell member when the releasing portion is manipulated with the pressure directed toward the holding portion.

5. An electrical connector according to claim 4, wherein the holding portion is operative to cause the engaging projection formed at the end of the cantilever arm to be put in the inside of the opening provided on the housing when the cantilever arm is put in contact with the positioning portion provided on the housing so that the holding portion in its entirety is restricted in position thereby and then to cause the engaging projection formed at the end of the cantilever arm to go away from the inside of the opening provided on the housing when the cantilever arm is put in contact with the contacting portion provided on the housing and the engaging projection formed at the end of the cantilever arm is moved to approach to the root of the releasing portion connected with the shell member.

6. An electrical connector according to claim 1, wherein a couple of sets of the holding portion, the releasing portion and the connecting portion of the shell member are formed in a body respectively in a pair of portions of the shell member which cover a pair of opposite end portions of one of the opposite plate-shaped portions of the housing, respectively.

* * * * *